US005947799A

United States Patent [19]

Kaoyashi et al.

[11] Patent Number: 5,947,799

[45] Date of Patent: Sep. 7, 1999

[54] AUTOMATIC LAPPING CONTROL

[76] Inventors: Michihiko Kaoyashi, 1018 Woodlane Dr., Mayfield Village, Ohio 44143; Franz L. Sauerland, 600 Falls Rd., Chagrin Falls, Ohio 44122

[21] Appl. No.: 08/974,643

[22] Filed: Nov. 19, 1997

Related U.S. Application Data

[63] Continuation-in-part of application No. 08/629,992, Apr. 5, 1996, abandoned.

[51] Int. Cl.[6] ..... B24B 49/00

[52] U.S. Cl. ..... 451/8; 451/1

[58] Field of Search ..... 451/8, 9, 1, 2, 451/10, 11, 12, 5

[56] References Cited

U.S. PATENT DOCUMENTS

| | | | |
|---|---|---|---|
| 3,994,154 | 11/1976 | Niklas et al. | 73/67.8 R |
| 4,114,455 | 9/1978 | Walker | 73/597 |
| 4,123,943 | 11/1978 | Roddy et al. | 73/623 |
| 4,197,676 | 4/1980 | Sauerland | 51/165 R |
| 4,199,902 | 4/1980 | Sauerland | 51/165 R |
| 4,272,924 | 6/1981 | Masuko et al. | 51/165 R |
| 4,407,094 | 10/1983 | Bennett et al. | 51/165 R |
| 5,136,817 | 8/1992 | Tabata et al. | 51/165.71 |
| 5,761,781 | 6/1998 | Teragaki | 29/25.35 |

FOREIGN PATENT DOCUMENTS

| | | | |
|---|---|---|---|
| 404063676 | 2/1992 | Japan | 451/5 |

*Primary Examiner*—Timothy V. Eley
*Assistant Examiner*—Dung Van Nguyen

[57] ABSTRACT

Method for identifying, monitoring, and controlling the blank frequencies in each separate carrier of a planetary lap machine, based on measuring blank frequency signals via an electrode imbedded in a lap plate, analyzing the time frequency pattern of these signals as they pass the electrode, correlating it with the sequence of carriers passing the electrode, and from that identifying and correlating groups of signals with the loads of blanks in each carrier, then monitoring the frequencies and the frequency spread in each carrier and, optionally, terminating lapping when frequencies and spread in a carrier exceed a target value.

4 Claims, 7 Drawing Sheets

AUTOMATIC LAPPING CONTROL

This application is a continuation in part of application Ser. No. 08/629,992 filed Apr. 5, 1996 abandoned.

BACKGROUND OF THE DISCLOSURE

Automatic lap control based on using piezoelectric monitor blanks has been described in prior-art U.S. Pat. Nos. 4,407,094, 4,199,902, and 4,197,676. It has since been implemented and applied as a thickness measuring instrument called "Automatic Lap Controller". One of its applications is in lapping and polishing of quartz resonator blanks in planetary lap machines, where it monitors the blank frequencies via an electrode imbedded in one of the lap plates. As the blanks are lapped thinner, their resonance frequency increases. When a target frequency is reached, lapping is stopped.

The operating principle is illustrated in FIG. 1. It shows a partial and simplified cross section of a planetary lap machine with an upper lap plate (2), lower lap plate (4), carrier (6), blank (8), electrode (12), and a lap plate center axis (18). A measurement circuit (20) applies a sweep frequency signal to electrode (12) and senses the current through the electrode and the adjacent gap between upper and lower lap plates to ground. When the electrode faces a blank, the circuit measures the blank's resonance frequency.

FIG. 2 shows a top view of the lap machine with the upper lap plate removed. A lower lap plate (4) supports eight carriers (6-1 . . . 6-8) which are driven by an outer gear ring (30) and inner gear ring (32) in planetary motion around the center axis (18). Each carrier carries 5 blanks in 5 holes. Blank 8 of FIG. 1 is located in carrier 6-1, and electrode 12 is shown as being located concentrically with blank 8. As the carriers rotate, blanks are measured as they pass the electrode.

The purpose of lapping is to lap a load of blanks to a target frequency while minimizing the "spread" between the highest and lowest blank frequencies. The spread of a lap load is the difference between the highest and the lowest frequency in the load. Its exact value cannot be determined during lapping because it is not possible to measure all frequencies at the same time and because all frequencies are increasing during the process. Instead, an approximate value is defined and determined as the difference between the highest and the lowest frequency of the lap load observed during a predetermined time interval.

The Automatic Lap Controller facilitates the lapping process in two ways: by terminating it when the highest blank frequency reaches a target frequency, and by monitoring the frequency spread during lapping.

Present lap controllers have limitations in that they can only monitor the spread of the whole lap load. Typically, a load of blanks has a spread when it is loaded into the lap, and properly operating lap machine reduces this spread during lapping by equalizing the thickness of the blanks. However, there are several reasons that can prevent a spread reduction and even produce a spread increase during lapping.

One reason can be a difference in the lap performance within individual carriers. For instance, the lapping in one carrier may be erratic and produce a spread larger than in all the others. Or, the lap rate in one carrier may differ significantly from that in the others. Both cases result in a large overall spread, although the spread in the individual carriers may be small. Present methods cannot detect the reason for a large overall spread nor provide a clue for correcting the problem.

This application discloses a lap controller that can identify and monitor the values for blank frequencies and frequency spread in each individual carrier, and that can signal the termination of lapping when these values reach a predetermined target.

SUMMARY OF THE DISCLOSURE

Present methods for controlling the lapping of piezoelectric blanks in planetary lap machines are based on monitoring the frequencies and the frequency spread of all blanks in the lap machine and on terminating lapping when the monitored values exceed predetermined target values. The methods cannot identify and monitor the groups of blanks located in each of the separate carriers.

This application discloses a method for identifying, monitoring, and controlling the frequencies and frequency spreads of the "carrier loads" in a planetary lap machine, based on measuring blank frequency signals via an electrode imbedded in a lap plate, analyzing the time frequency pattern of these signals, correlating it with the sequence of carriers passing the electrode, and from that identifying and correlating groups of signals with the loads of blanks in each carrier, then monitoring the frequencies and the frequency spread in each carrier and, optionally, terminating lapping when the frequencies and spread of a "carrier load" exceed a predetermined value.

DESCRIPTION OF THE PREFERRED EMBODIMENTS

The disclosed method is used for identifying, monitoring, and controlling the frequencies and frequency spreads of the "carrier loads" in a planetary lap machine. This type of machine typically includes a number (N) of carriers, each carrier holding a carrier load of blanks. During operation, all carriers revolve in a planetary movement around their own center axis and around the machine's center axis. They move between upper and lower lap plates, which may or may not revolve around the machine's axis. In the disclosed method, at least one electrode is imbedded in one of the lap plates and connected to external circuitry that measures the frequency signal of any blank passing the electrode.

Figure 5:
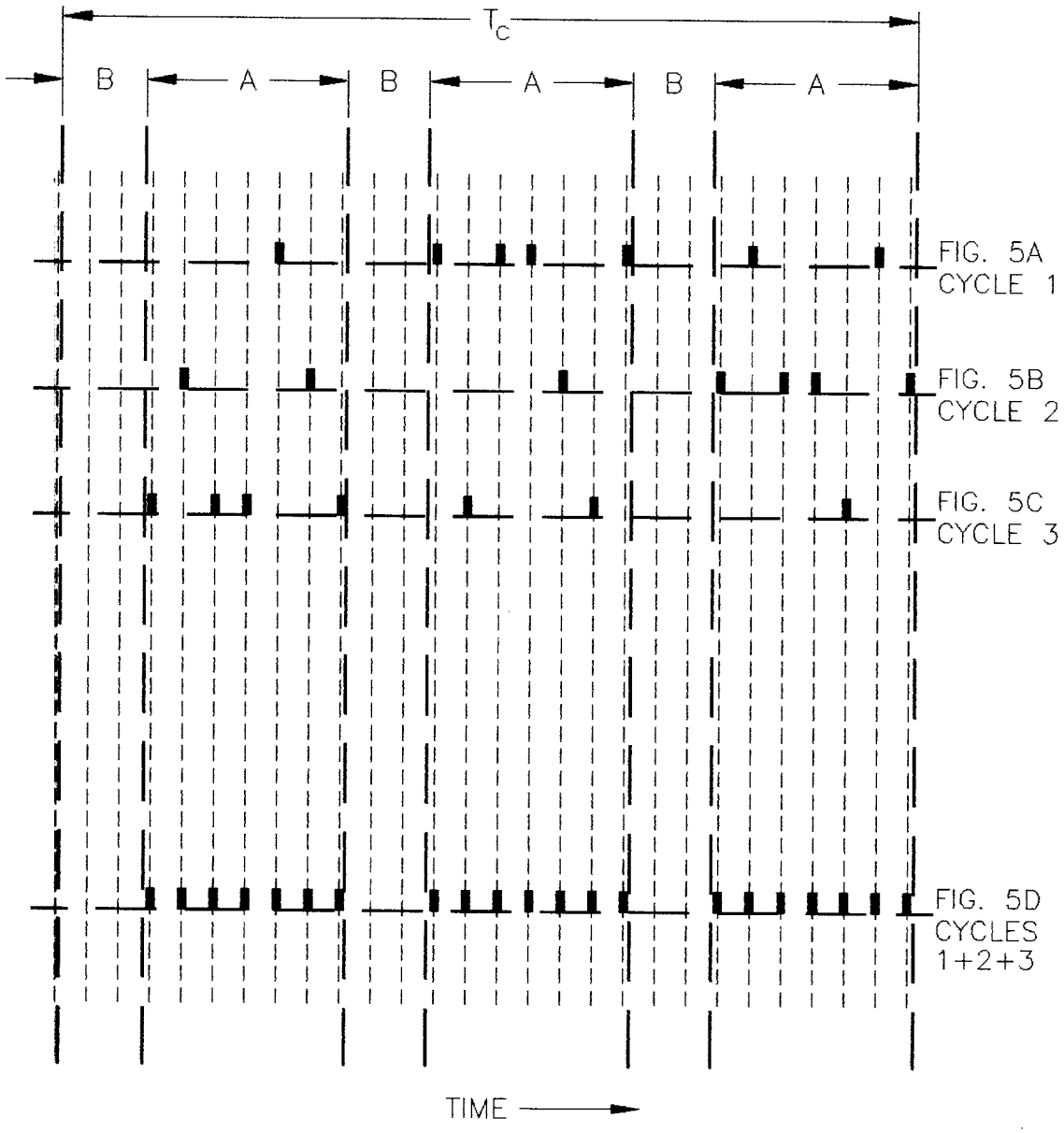
FIG. 5 shows another example of a hypothetical blank signal time distribution for a constant-speed lap operation with 3 carriers.

Typically (but not necessarily), during a time Tc for one full revolution of all N carries passing the electrode, at least one blank per carrier will be measured. With enough revolutions, most or all blanks in each carrier load will be measured. This can be illustrated in a time pattern by plotting the incidence of the blank signals for multiple revolutions versus the revolution time Tc. An example for a lap with N=3 carriers is shown in FIG. 5, which is explained in detail further below. The pattern shows:

N intervals B during which there are no signals. They correspond to the N spacings between the carriers during which no blanks can be passing the electrode. These intervals will be called "inter-carrier intervals".

N intervals A containing blank signal groupings that correspond to the individual carrier loads. The intervals alternate with the inter-carrier intervals and will be called "intra-carrier intervals".

The revolution time Tc may not be known beforehand, but it can be determined in the process of locating the inter-and intra-cattier intervals by means such as successive approximation or optimization.

A main purpose of the method is to identify a number of blanks (not necessarily all) in each carrier load and to measure and monitor their frequencies and the frequency spread of each carrier load during lapping. The accuracy of the measurements is determined by the number of blanks sampled in each carrier.

The method is complicated by several peripheral aspects, including the fact that during a sampling interval of multiple revolution times, all frequencies measured during that interval are changing continuously. The peripheral aspects will be ignored for this explanation.

The method includes the following steps:

A) Locating an electrode in a lap plate, connecting it to an external measurement circuit, and measuring blank frequencies as blanks pass the electrode;

B) Determining which of the signals pertain to which carrier load by analyzing the time pattern of the signals and determining periodic cycles of N time intervals during which no signals are observed;

identifying these time intervals as the N inter-carrier intervals per cycle during which the electrode is facing the spacing between two adjacent carriers;

identifying the N intervals alternating with the N inter-carrier intervals per cycle as the intra-carrier intervals during which the electrode is facing a carrier and may encounter blank signals that pertain to its carrier load;

monitoring the blank frequency signals of each carrier load over repeated sampling-time intervals;

C) Defining a "carrier-load spread" as the difference between the highest and lowest frequency measured in the carrier load during the sampling-time interval, and monitoring the frequencies and the frequency spread of each carrier load.

D) Determining target criteria for terminating lapping, including a target value for a maximum allowable carrier load spread;

E) Terminating lapping when a target is reached, including the target for the carrier load spread;

F) After terminating lapping, identifying by inspection the carrier which last passed the electrode, and from that assigning the carrier load data to specific carriers;

G) If lapping was terminated for exceeding the carrier load target, identifying the carrier(s) causing the high spread.

Among these steps, Step B embodies the main part of the disclosure. Step A is prior-art and has been described in the quoted prior-art references. Steps C through G are based on applying prior-art definitions and practices to the disclosed art.

Step B is explained below by means of an example. For this, the following definitions will be used:

"carrier load" is the load of blanks in a single carrier of the N carriers in the lap machine;

"lap load" is the total load of blanks in all N carriers;

"carrier spread" is the difference between the highest and lowest blank frequencies of a carrier load, observed over a predetermined time interval;

"carrier revolution time Tc" is the time for one revolution of all N carriers passing the electrode.

Figure 3:
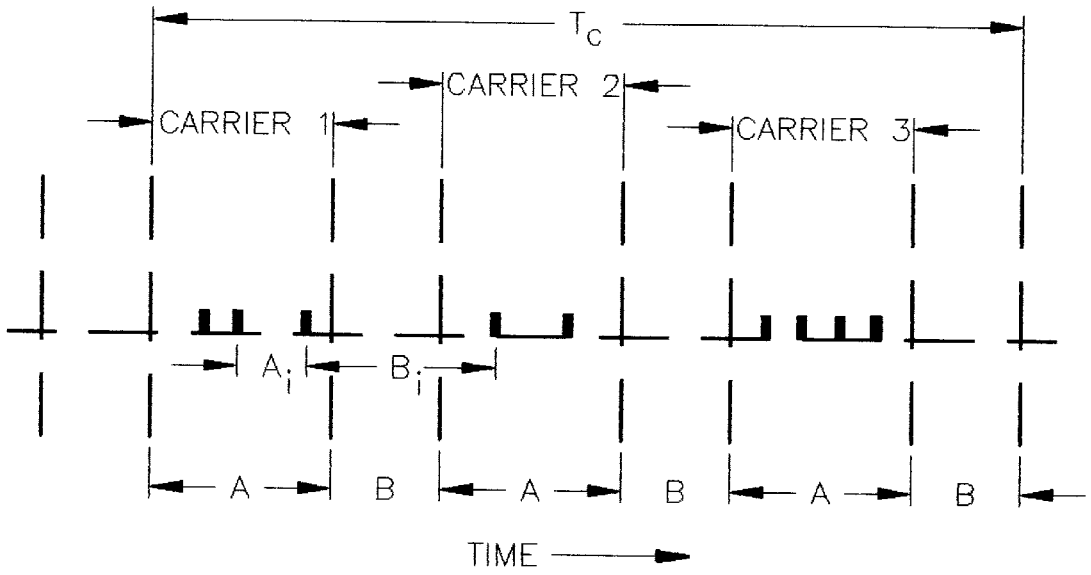
FIG. 3 shows an example of a hypothetical blank signal time distribution for a constant-speed lap operation with 3 carriers.

FIG. 3 shows a simple hypothetical blank-signal time distribution for a constant-speed lap operation with 3 carriers, observed over a carrier-revolution time Tc. The signal time stamps are indicated by bold-line columns. The inter-carrier intervals are marked as B and indicated by dashed vertical lines. The intra-carrier intervals are marked as A. The figure is based on the simplifying assumption that there are at least two blank signals within each intra-carrier interval, separated from each other by time intervals that are smaller than the interval between the last blank signal in one intra-carrier interval and the next blank signal in the subsequent intra-carrier interval. If these conditions hold for all carrier revolution cycles, the time pattern of alternating inter-and intra-carrier intervals can be recognized. Further, at the end of lapping, the carrier that last passed the electrode can be determined by its position relative to the electrode. In this way, all carriers can be identified and correlated with the signals of their respective carrier loads.

One way of recognizing the pattern of FIG. 3 is via computer and software, as illustrated by the following simple example, which is based on these assumptions:

the lap has N carriers and one electrode, and it runs at constant speed;

each time a carrier passes the electrode, there are at least two signals per intra-carrier interval, separated from each other by time intervals Ai;

Bi is the interval between the most recent signal in one carrier and the next signal in the following carrier;

"Amax", the largest of the intervals Ai, is smaller than "Bmin", the smallest of the intervals Bi.

These conditions can be expressed as follows:

(1) $Amax<K1\times Amin$ (2) $Bmin>K2\times Amin$, or (2A) $Bmin>Amax\times K2/K1$ The constants K1 and K2 depend on the specific lap machine and carrier geometries. For the example, let K1=1.5 and K2=3

The carrier detection scheme works as follows:

Suppose a blank signal is observed and assigned to "Carrier 1". To determine whether the next observed signal corresponds to a blank in the same carrier or in the next "Carrier 2", apply these steps:

1. Compare each new time interval "In" with the preceding interval "Ip" according to condition (2A).
2. If $In>2\times Ip$, the new signal corresponds to a blank in the next "Carrier 2". However,
3. If $In<2\times Ip$, the new signal corresponds to another blank in Carrier 1".

From here, loop back to Step 1. After N loops, some blanks in all N carriers have been monitored once, and a new cycle starts to monitor the same carriers again.

Figure 4:
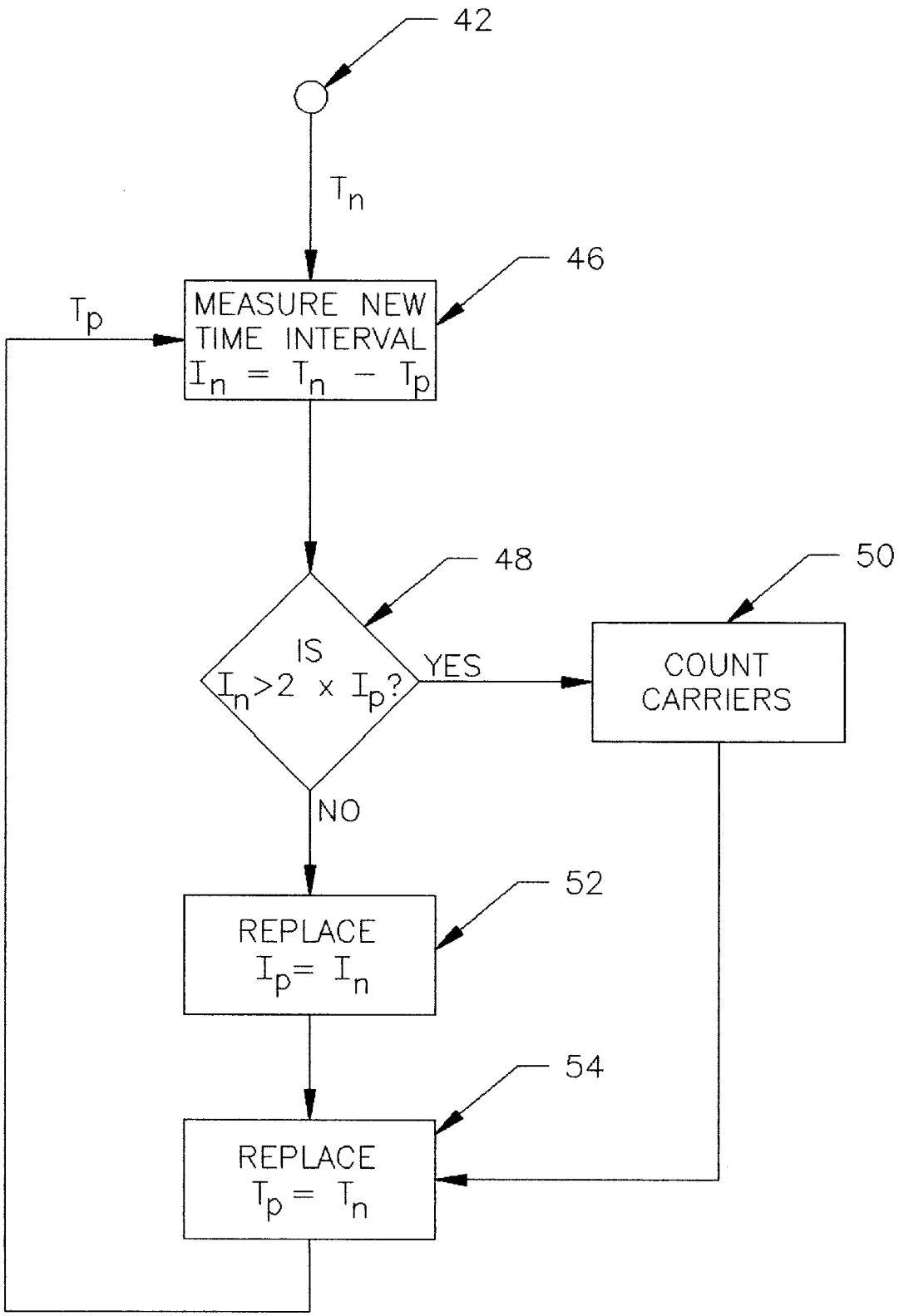
FIG. 4 shows a software flow chart for the example of FIG. 3.

FIG. 4 shows a flow chart for this software example. Block 46 has two inputs, the signal time-stamps Tn and Tp. Tn is the time at which a "new" signal occurs. Tp is the time at which the "previous" signal occurred. The difference between the two times is the "new" time interval In=Tn−Tp, which is applied to block 48 and tested whether it satisfies the condition In>2×Ip If the result is "no", the new signal belongs to carrier one. The result is applied to Block 52, which has stored the previously observed interval "Ip" and replaces it with the "new" interval In. From there, the flow proceeds to Block 54.

If the result is "yes", the new signal belongs to the next carrier. This is signaled to Block 50, which records the carrier time sequence. From there, the flow also proceeds to Block 54, where the "previous" time Tn is replaced by the "new" time Tn and returned to Block 46.

The process is repeated for all N carriers and further continued until the end of lapping. During this time, the frequencies for each individual carrier load are monitored. From this, one can also determine the spread of each carrier load according to the definition that it is the difference between the highest and the lowest frequency measured in a carrier load during a predetermined time interval.

One can also determine an average frequency for each carrier load, provided one takes into account the frequency increase during the predetermined time interval.

Further, one can effect a termination of lapping when the values for spread and average frequency of any carrier load reach a target value.

The described approach identifies the frequencies for the sequence of the N carrier loads. When the lap machine stops, the carrier that was monitored last can be identified (by visual inspection) from its position relative to the electrode. From this the remaining carriers and carrier loads can be identified.

While the example of FIG. 3 shows a simple hypothetical signal distribution, practical cases can be more complex. For instance, FIG. 5 illustrates a hypothetical three-carrier case where the simplifying assumption pertaining to FIG. 3 does not apply. FIGS. 5A, 5B, 5C show signal distributions observed over 3 separate carrier cycle intervals Tc. None of them suggest a pattern that distinguishes between intra-carrier intervals A and inter-carrier intervals B. However, the addition of these distributions according to FIG. 5D shows a clear pattern, which becomes more distinct as further cycles are observed. The signal groupings can be correlated with the frequencies and frequency spreads of individual carrier loads.

The pattern of example FIG. 5 can be recognized with the help of a computer. If the carrier revolution time Tc is known, the signal time distributions for subsequent carrier cycles can be aligned and added in a manner similar to FIG. 5. This approach has been implemented in a computer program.

The carrier revolution time Tc can usually be predetermined for a given lap machine and lap speed. If Tc is not known exactly, the computer program can determine the exact value.

Figure 1:
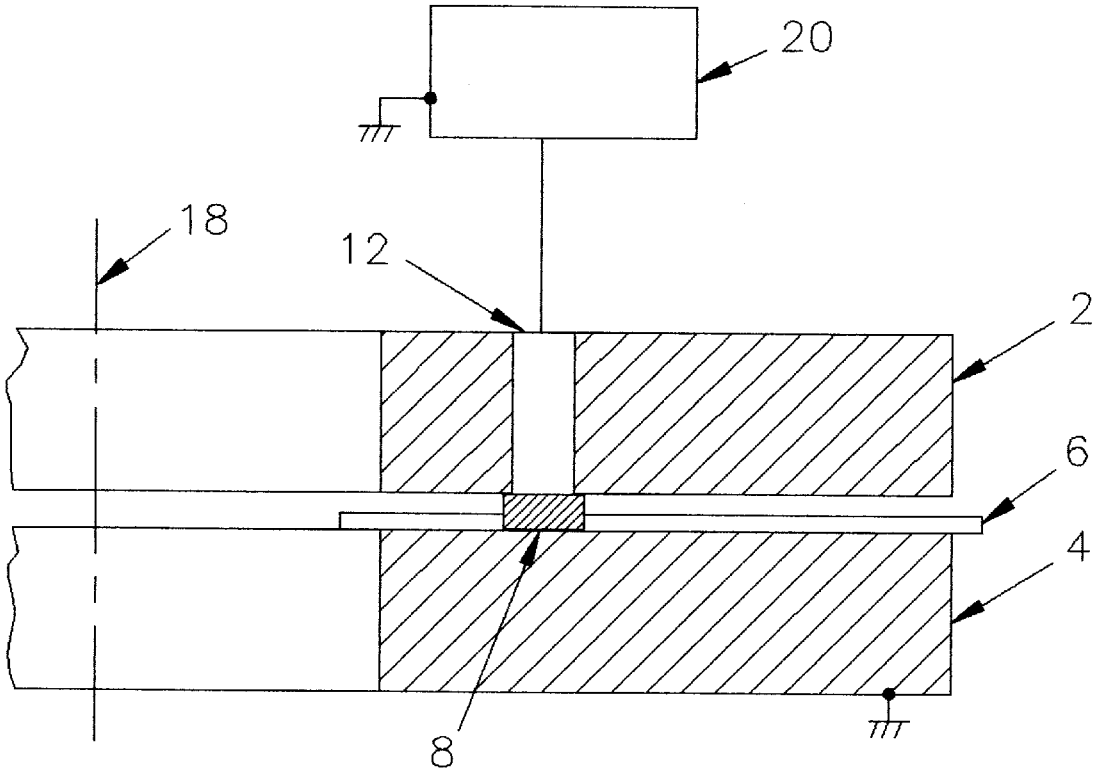
FIG. 1 shows the principle of prior-art lap control.
Figure 2:
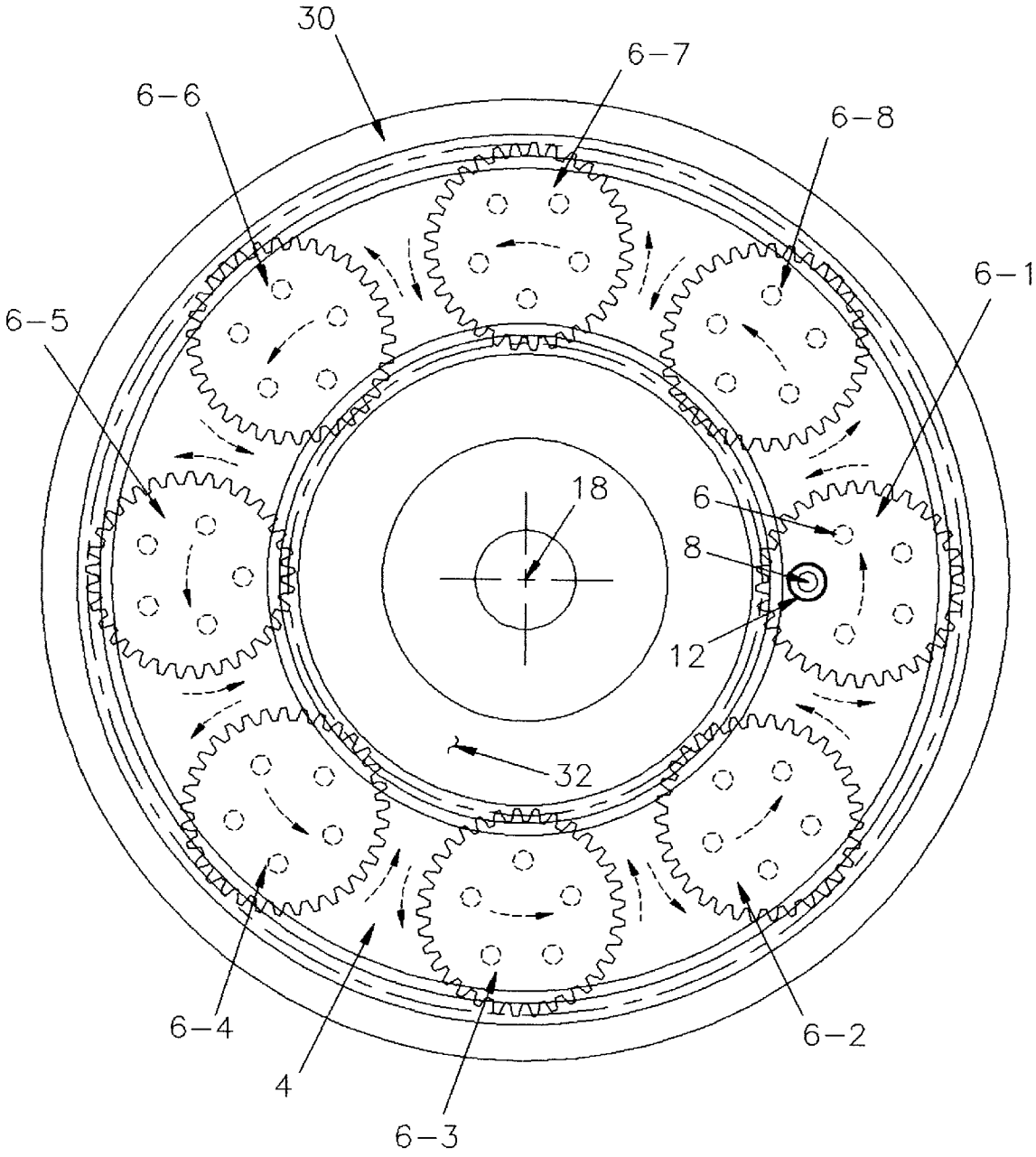
FIG. 2 shows the top view of a prior-art planetary lap machine with one imbedded electrode.

In the examples per FIGS. 1 and 2, a single electrode is used, and it takes multiple carrier cycles until all blanks in a carrier have been measured. The longer the time interval required for this, the more the frequencies change during this interval, and the slower the pattern recognition process. One way to reduce this interval and to increase the sampling rate is to use more than one electrode.

Figure 6:
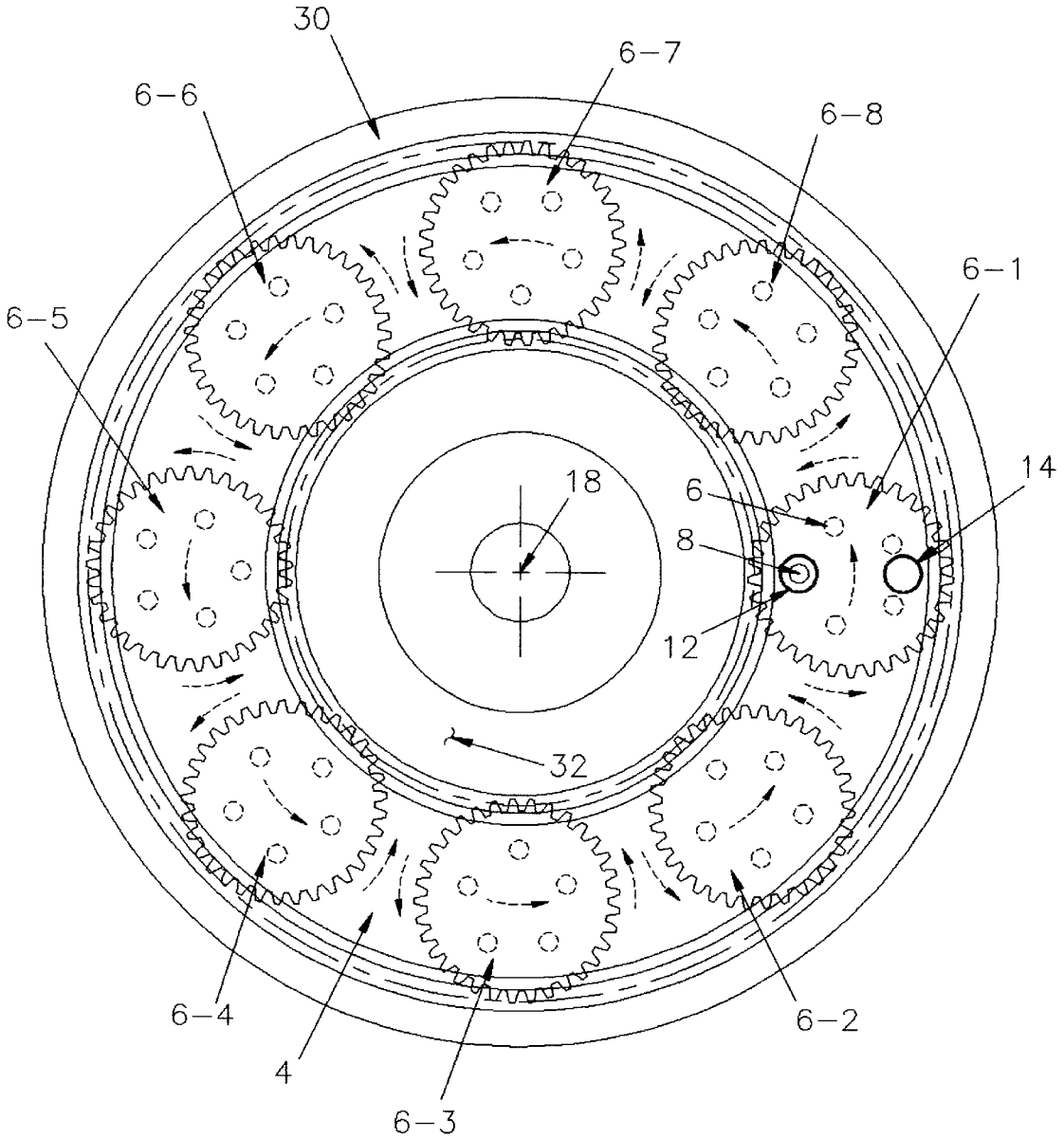
FIG. 6 shows the top view of a prior art planetary lap machine with two imbedded electrodes.

FIG. 6 shows an arrangement with two electrodes, which provides about twice the sampling rate. The figure is a duplication of FIG. 2 except that a second electrode (14) has been added.

Figure 7:
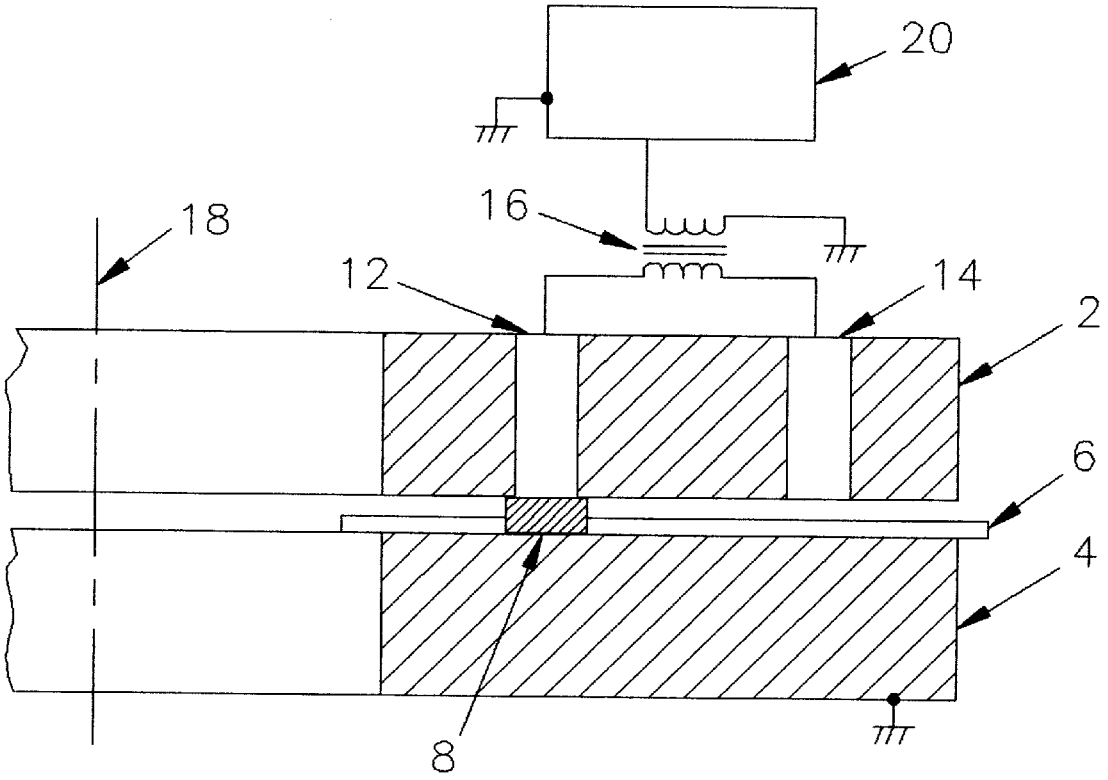
FIG. 7 shows an prior-art electrical connection of two electrodes to a single frequency measuring circuit.

FIG. 7 shows one way of connecting the two electrodes to a single measurement circuit. The figure is a duplication of FIG. 1, except that a second electrode (14) and a transformer (16) have been added. The transformer connects the two electrodes in series. If one electrode faces a blank, the other one usually confronts the gap between the two lapping plates, which is filled with the carrier or the lapping slurry or both. This gap represents a short circuit for the blank signal. In the rare case where both electrodes face a blank, the signal may be distorted and may need to be discarded.

The values for frequencies and spread of the individual carrier loads can be displayed by the lap controller. Further, the controller can signal or actuate the termination of lapping when these values reach a predetermined target.

We claim:

1. In conjunction with a planetary lap machine having carriers for conveying blanks, the lap machine being usable for lapping and polishing piezoelectric blanks for monitoring resonance frequencies of said blanks via at least one electrode embedded in a lap plate, and for automatically terminating lapping upon a signal that is triggered when reaching a lapping target, a method for monitoring and distinguishing from each other the frequencies of the blanks in each carrier of the planetary lap machine, the method comprising:

measuring blank frequency signals as blanks pass the electrode;

analyzing time patterns of the signals and determining repeating cycles of time intervals during which no signal is observed;

identifying time intervals inter-carrier intervals during which the electrode is facing a spacing between two adjacent carriers;

identifying intervals alternating withe the inter-carrier intervals as intra-carrier intervals during which the electrode is facing a carrier and can encounter blanks of its carrier load;

identifying signals in each intra-carrier interval with blank signals for a corresponding carrier load;

monitoring the blank frequency signals of each carrier load over repeated sampling-time intervals;

defining a "carrier load spread" as a difference between the highest and the lowest frequency measured in a carrier load during a sampling-time interval;

monitoring the frequencies and the carrier load spread of each carrier.

2. Method according to claim 1, further including determining targets for terminating lapping, including a target value for a maximum allowable carrier load spread;

terminating lapping when a target value is reached, including the target for the carrier load spread;

after terminating lapping, identifying by inspection the carrier which last passed the electrode, and from that correlating carrier load data with specific carriers.

3. Method according to claim 1, further comprising using more than one electrode in a lap plate.

4. Method according to claim 1, further using a computer and software for recognizing the blank signal time pattern and correlating it with individual carrier loads.

* * * * *